US005263501A

United States Patent [19]

Maznik

[11] Patent Number: 5,263,501

[45] Date of Patent: Nov. 23, 1993

[54] STEAM HAIR STYLING APPARATUS

[76] Inventor: Gary R. Maznik, 5827 Grovewood Dr., Mentor, Ohio 44060

[21] Appl. No.: 904,989

[22] Filed: Jun. 26, 1992

[51] Int. Cl.[5] ..... A45D 7/02

[52] U.S. Cl. ..... 132/211; 132/227; 132/228; 132/272

[58] Field of Search ..... 132/211, 227, 228, 229, 132/230, 231, 232, 233, 271, 272

[56] References Cited

U.S. PATENT DOCUMENTS

| | | | |
|---|---|---|---|
| 3,224,454 | 12/1965 | Quinio et al. | 132/232 |
| 3,610,259 | 10/1971 | Brown | 132/232 |
| 3,702,616 | 11/1972 | Mercer | 132/272 |
| 3,800,810 | 4/1972 | Mercer | 132/272 |
| 3,805,811 | 4/1974 | Dorn | 132/228 |
| 3,918,465 | 11/1975 | Barradas | 132/37 R |
| 3,921,648 | 11/1975 | Barradas | 132/228 |
| 3,934,597 | 1/1976 | McNair | 132/37 |
| 4,166,473 | 9/1979 | Bauer et al. | 132/272 |
| 4,341,229 | 7/1982 | Bauer | 132/7 |
| 4,388,936 | 6/1983 | Roberts | 132/227 |
| 4,565,204 | 1/1986 | Skovdal | 132/39 |
| 4,632,133 | 12/1986 | Losenno | 132/231 |
| 4,936,027 | 6/1990 | Tsuji | 34/90 |

FOREIGN PATENT DOCUMENTS

| | | | |
|---|---|---|---|
| 0103163 | 8/1979 | Japan | 132/228 |

*Primary Examiner*—Gene Mancene
*Assistant Examiner*—Frank A. LaViola
*Attorney, Agent, or Firm*—Oldham, Oldham & Wilson Co.

[57] ABSTRACT

A hair curling apparatus for subjecting a tress of hair, previously wound about a cylinder, to a vaporized fluid for imparting a resilient and lasting curl to the hair upon removal of the cylinder. The apparatus comprises, generally, a handle containing a refillable fluid reservoir, a heating element for heating the fluid to vaporization, a barrel extending outward from the handle and containing a plurality of steam releasing holes, a channel for communicating the vaporized fluid from the reservoir to the barrel and a trigger mechanism for activating and metering the volume of fluid passed through the channel.

13 Claims, 4 Drawing Sheets

STEAM HAIR STYLING APPARATUS

TECHNICAL FIELD

This invention relates generally to the art of hair styling and more specifically to subjecting a tress of hair to an application of steam for the purpose of imparting a resilient and lasting curl to the hair. The apparatus comprises, generally, a handle containing a refillable fluid reservoir, a heating element for heating the fluid to vaporization, a barrel extending from the handle and containing a plurality of steam release holes, a channel for communicating the vaporized fluid from the reservoir to the barrel and a trigger mechanism for activating and metering the volume of fluid passed through the channel and into the barrel for introduction to the hair.

BACKGROUND OF THE INVENTION

Many techniques are known for altering the natural appearance of one's hair. A principle distinction in the most commonly used methods is based on the permanence of the alterations. Permanent or wave techniques suggest a relatively long term imparting of style or shape to the hair generally employing chemical treatment. When using these techniques the shape or style will return to the hair even after numerous washing or wetting of the hair.

The term "setting" refers to a more temporary imparting of style to the hair than permanent or wave techniques such that the hair will return to its original, untreated shape or appearance upon exposure to significant moisture or the application of pressure.

Many methods of hair setting exist. Perhaps the most common consists of winding moist hair about rollers and curlers. The hair is substantially dried while wound on the roller and thereafter removed and brushed or combed to complete the styling.

Alternatively, moist hair may be styled by simply teasing or repeatedly brushing the hair in a specific pattern while concurrently applying heat to the hair.

Still further style or shape can be imparted to hair using a version of the well known curling iron. The curling iron imparts shape to a tress of hair through its contact of a heated mandrel to the hair. The hair is normally held against the mandrel for a specified length of time. As a variation of this technique, the curling iron may also administer steam through apertures in the mandrel while held against the hair.

The curling iron possesses a disadvantage inherent to its irregular and uneven treatment of the hair. In many models the mandrel is unevenly heated in that the portion closest to the heating element oftentimes achieves a temperature greater than that portion of the mandrel remote of the heating element. Still further the individual hair fibers receive differential treatment based on whether they are in direct or indirect contact with the mandrel.

The applicant has determined, through use of all of the aforementioned techniques, that the best hair setting results are obtained when all of the hair to be styled is treated uniformly. Furthermore, the applicant has determined that the best hair setting is achieved after the hair has been substantially dried by any conventional means and thereafter subjected uniformly only to an application of steam or other vaporized liquid, as opposed to the combination of steam and heat or the application of heat alone as offered by conventional curling irons.

Therefore, in light of the foregoing deficiencies in the prior art, applicant's invention is herein presented.

SUMMARY OF THE INVENTION

The present invention is directed to an apparatus and related method for imparting a resilient and lasting curl to a tress of hair using the metered application of vaporized fluid to the hair. In contrast to prior art curling irons which subject the hair to dry heat in order to style or curl the hair or other curling iron devices which utilize steam in combination with dry heat, the inventor has found that superior and healthier style or curl is produced in virtually all types of hair using the application of steam or vaporized fluid independent of the drying of the hair, such that following exposure the hair quickly cools to ambient temperature. Therefore, the apparatus of the present invention applies steam or vaporized fluid to a tress of hair while the hair is wound about a cylindrical hair roller or curler.

The apparatus comprises, generally, a handle containing a refillable fluid reservoir, a heating element for heating the fluid to vaporization, a barrel extending from the handle and containing a plurality of steam release holes, a channel for communicating the vaporized fluid from the reservoir to the barrel and a trigger mechanism for activating a transfer mechanism, such as a simple pump or the like to transfer and meter the volume of fluid passed through the channel and into the barrel for introduction to the hair. This unit is connected to a source of electrical current, typically AC or DC for powering of the heating element and/or transfer mechanism. The trigger mechanism is configured such that upon depression a "burst" of steam or vaporized fluid is emitted from the plurality of holes about the periphery of the barrel. The barrel is preferably of sufficient diameter to be easily inserted and removed axially from the internal bore of a cylindrical roller.

It is also preferable, although not absolutely required, that the barrel be of a diameter so as to bring the periphery of the barrel in as close proximity to the tress of hair as possible. This is accomplished with a barrel having a diameter slightly smaller than the inner diameter of the roller.

An alternative embodiment of the present invention employs a unique hair roller or curler used in association with the aforementioned styling apparatus and is of a generally cylindrical configuration containing a plurality of securing sites for attachment of an associated clip or hairpin, positioned about the outer periphery of the curler and an axial bore therethrough, dimensioned slightly larger than the outer diameter of the corresponding apparatus mandrel so the longitudinal axis of the mandrel is located essentially equidistant from any point on the periphery of the roller. In this way, any portion of the hair wound about the roller will be similarly positioned essentially equidistant from the mandrel. The wall of the roller between the axial bore and the periphery contains numerous slots or openings sufficient to permit the free passage of steam or other vaporized liquid from the mandrel to the hair.

It is therefore, an object of the present invention to provide an apparatus for the uniform application of steam or other vaporized liquid to a tress of hair wound about a cylindrical member or roller for imparting the essential shape of the cylindrical member or roller to the hair.

It is a further object of the present invention to provide an apparatus for imparting lasting style to a tress of hair with less risk of injury to the hair or scalp.

It is still a further object of the present invention to provide an apparatus for imparting lasting style to a tress of hair wound about a cylindrical member exclusively through the application of steam or vaporized liquid.

These along with other objects and advantages of the present invention will become more readily apparent from a reading of the detailed description taken in conjunction with the drawings.

DETAILED DESCRIPTION OF THE PREFERRED EMBODIMENT

Figure 1:
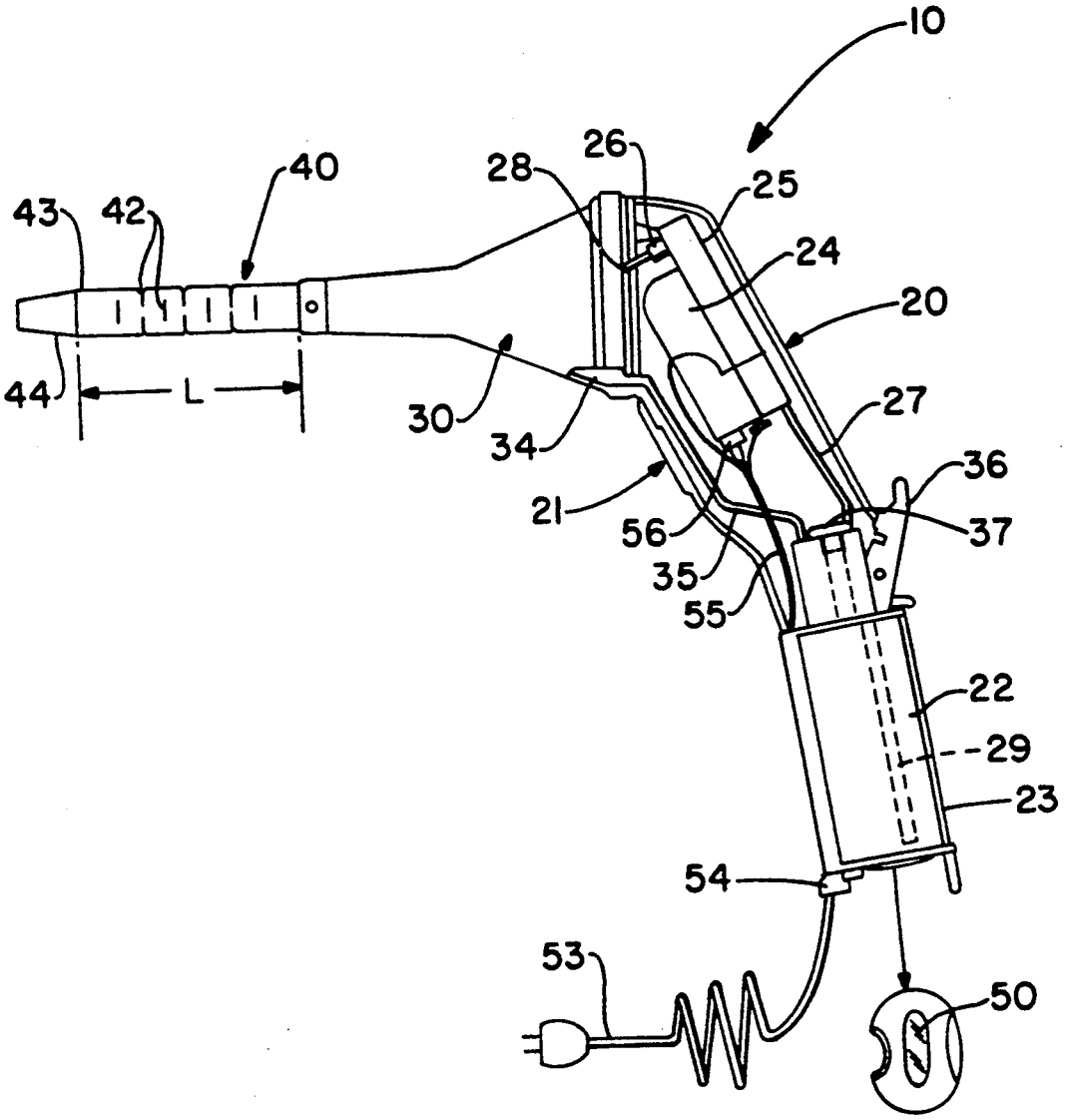
FIG. 1 is a side elevational view of a steam hair styling apparatus wherein a portion of the housing has been removed to reveal its internal structure.

The apparatus of the present invention, generally 10, illustrated in FIGS. 1–9, comprises a housing 20 from which a mandrel or barrel 40 extends from one end. Apparatus 10 employs the application of steam, mist or other heated fluids to a tress of hair previously wound upon a roller or curler to impart lasting style to the hair.

Housing 20 further comprises generally a fluid reservoir 22, a heating element 24 for generating vapor from the fluid contained in the reservoir 22, a pressure device 26 for metering and communicating the vapor across a heating plate 25 to the barrel 40 and an actuating button or trigger 36 for controlling the release of vapor into barrel 40.

In the preferred embodiment, shown in FIG. 1, applicant has used a valet steamer 21 to singly accomplish the purposes of the housing 20, reservoir 22, heating element 24, pressure device 26 and actuating device 36. Applicant has used a Sunbeam Valet Steamer, Model 10079, although it can be appreciated that numerous other clothing steamers may be equally suitable.

Figure 2:
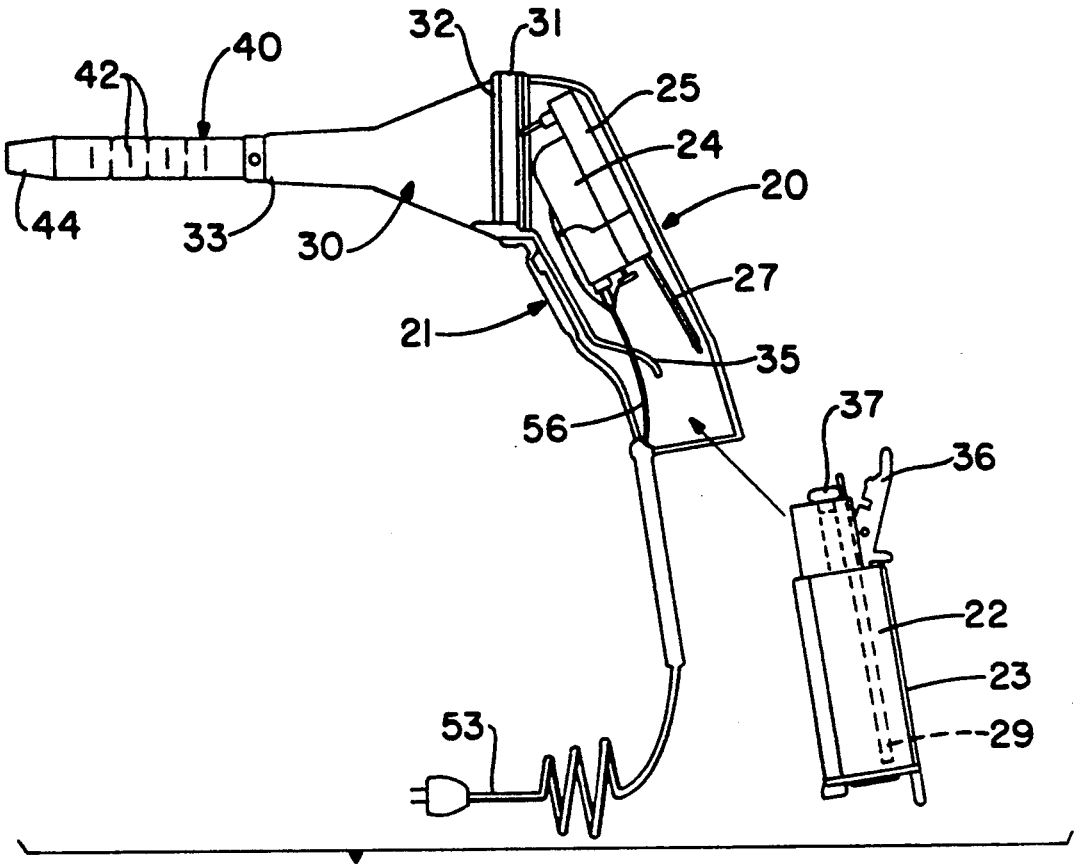
FIG. 2 is a partially enclosed side elevational view of a steam hair styling apparatus, illustrating the detachable handle and wherein a portion of the housing has been removed to reveal its internal structure.

Steamer 21 of the preferred embodiment shown in FIG. 1 utilizes a fluid reservoir 22 contained in a removable handle 23 and as further illustrated in FIG. 2. A flexible tube 29 penetrates an internal cap 37 of reservoir 22 to access the fluid contained therein. The pressure device or atomizer 26 when actuated by trigger mechanism 36 causes a metered amount of fluid to be drawn up through tubes 29 and 27 and across heating plate 25 located in the housing near the sight of steam emitting orifice 28 and serving as the vapor generating mechanism. Heating plate 25 is comprised of a thermal conductive material heated by heating element 24. Fluid is heated as drawn through or across heat plate 25. The atomizer 26 releases the metered fluid in the form of a heated mist which is readily vaporized into steam as it exits the steam releasing orifice 28. The atomizer 26 dispenses the vaporizing mist with sufficient outward force so as to direct the now converted steam through a vapor cone 30 and into barrel 40 where it exits barrel 40, via a plurality of steam releasing holes 42. It is preferable that heating plate be removable for periodic cleaning as accumulation of residue resulting from the repeated passage and vaporization of water and water based solutions is anticipated.

Figure 3:
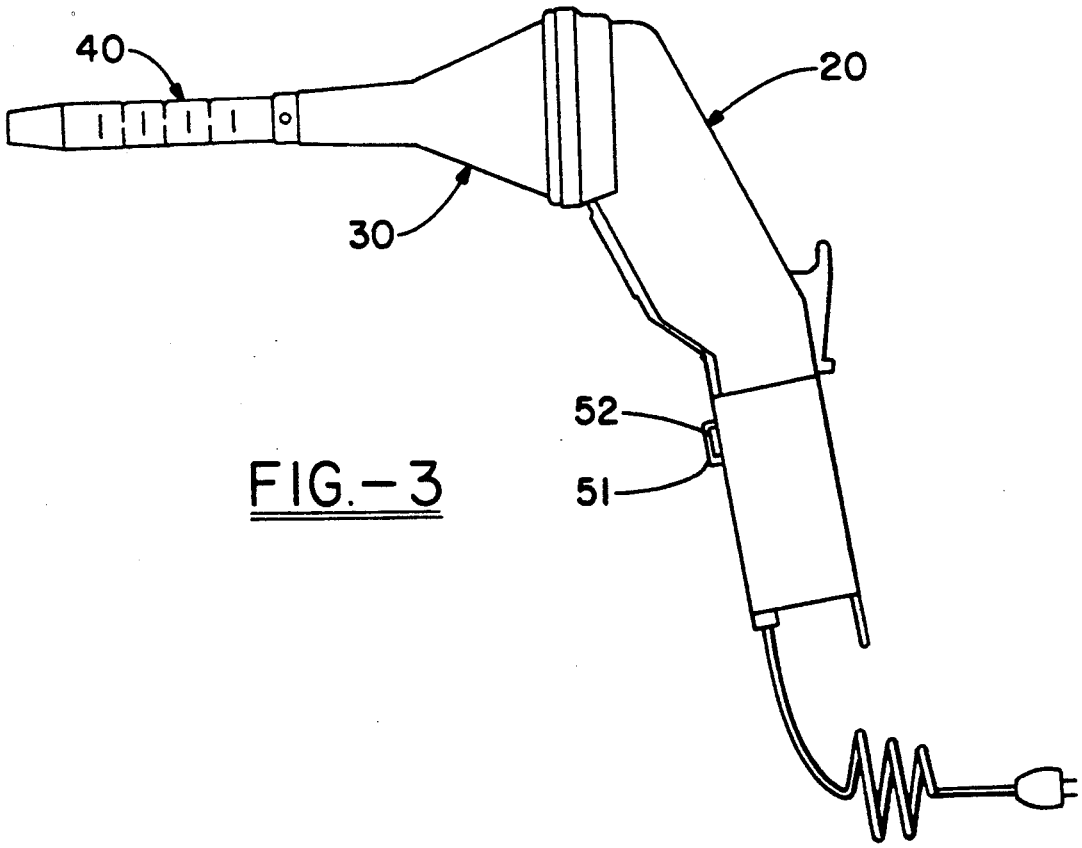
FIG. 3 is a side perspective view of the steam hair styling apparatus of FIG. 1.

Steamer 21, as shown in FIGS. 2–3, is modified to include a collar 31 in proximity of the steam emitting orifice 28. The vapor cone 30 is utilized to interconnect the steam emitting orifice 28 to barrel 40. The vapor cone 30, as best illustrated in FIG. 2, is essentially funnel shaped having a wide opening at one end 32 and dimensioned to engage collar 31. Vapor cone 30 tapers along its length such that the second open end 33 is slightly greater or slightly smaller than the diameter of barrel 40 to which it is interconnected using any means commonly known in the art, thus providing a continuous passage from steam emitting orifice 28 to barrel 40.

Looking again to any of FIGS. 1–3, barrel 40 is an essentially tubular mandrel operatively interconnected with housing 20. Barrel 40 is closed at the end 43 opposite housing 20 but contains a plurality of vapor emitting holes or vents 42 radially disposed about the periphery along a substantial portion of the barrel's length (L). These holes 42 are contemplated as having any geometric shape, provided they are of sufficient diameter to permit the essentially even release of vapor around the entire periphery of barrel 40. A plastic end cap 44 is attached to end 43 of barrel 40. End cap 44 is preferably tapered away from barrel 40 to aid in the insertion of barrel 40 in a hair roller.

As the barrel 40 of the present invention is not intended to be connected to a heat source independent from the vapor generating heating element 24 the barrel 40 can be made from any rigid material capable of withstanding the temperature of the emitted vapor. While aluminum is currently the preferred material, other materials including plastics and poor heat conductive metals are contemplated, provided that the repeated exposure of steam or other heated vapor does not cause deterioration of the material. In fact, the applicant has determined that lasting curls are best achieved by the exclusive application of the vaporized solution to the hair without a secondary heat source such as the dry heat commonly employed in steam curling irons. Therefore, poor thermal conductive materials can be employed as well as rapid heat dissipating materials such as aluminum and the like. Through the use of such materials in the composition of the barrel 40 as well as the intention not to utilize a secondary heat (dry) source with barrel 40, the user's risk of incurring a burn from contact with the barrel 40 is greatly reduced. It is intended that barrel 40 be capable of direct handling within seconds after use. Length (L) of barrel 40 is intended to range between 2–8 inches or at least as long as a corresponding curler, so that steam is emitted to the hair along substantially the total length of the curler. The diameter of barrel 40 is a contemplated as ranging from ⅜ inches to about 1 inch. Barrel 40 maybe constructed so as to be removable from said housing 20 and replaced with similar barrels of varying diameter.

As previously referred to above, housing 20 contains a reservoir 22 for holding water or water based solutions for subsequent vaporization and application to the hair. Such solutions may include conditioners, setting solutions and the like.

As previously discussed and illustrated in FIG. 2, the currently preferred embodiment utilizes a detachable handle 23 capable of separation from housing 20 and containing a fluid reservoir 22. The detachability of handle 23 is thought to reduce the risk of possible electrical shock during the refilling of fluid reservoir 22. Fluid is introduced in reservoir 22 through an aperture exposed by the removal of cap 37. Detachable handle 23 further includes a viewing window 50 enabling a user to monitor the amount of solution remaining in the reservoir.

In an alternative embodiment shown in FIG. 3, handle 23 is not detachable. In this embodiment fluid reservoir 22 opens to the outer surface of handle 23 enabling the reservoir 22 to be refilled. A removable cap 51, threadably engages reservoir opening 52, although alternative engagement may also be achieved by other means known in the art.

It is recognized that a small amount of the steam may condense in vapor cone 30 prior to entering barrel 40. Therefore, a return trough 34 is provided in the lower portion of vapor cone 30 to collect the condensing fluid. The return trough 34 is configured to direct the condensing fluid back into the housing and further includes an aperture at a location remote from barrel 40 to which a fluid return tube 35 is attached. The opposite end of this fluid return tube 35 is in communication with the reservoir 22 effectively returning the condensed fluid to the reservoir. Compensation in vapor cone 30 can be further reduced by moving the steam emitting orifice further into vapor cone 30 and closer to barrel 40.

In order to effectively style the hair as desired, the heating element must be capable of heating the fluid to a temperature ranging between 100° and 150° C., with a temperature ranging from 105° to 125° C. being most preferable. A thermostat 56 or governer is preferably included to limit as well as control the temperature of the heated steam.

Apparatus 10 of the preferred embodiment utilizes electrical power from a conventional alternating power source (AC) through an electrical cord 53, although it is appreciated that power sources such as direct (DC) current and even liquid fuels such as butane and the like are contemplated as alternative power sources. Electrical cord 53 is optionally connected to a swivel connector 54 located at the rear of the housing 20. The swivel connector 54 prevents raveling of cord 53. Cord 53 is operatively connected to heating element 24 via UL approved electrical wiring 55.

Within housing 20, there is affixed a conventional, manually operable on-off switch (not shown), which is in circuit with the electrically energized heating element. Also a small indicator lamp (not shown) for indicating whether the apparatus is on or off as well as a an adjustable thermostat for controlling the temperature of the heating means are optionally connected in circuit.

Figure 4:
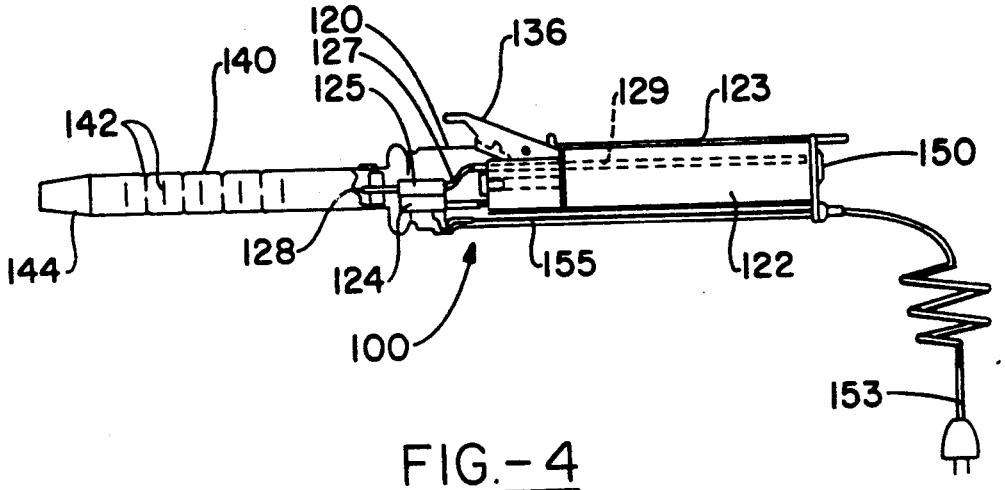
FIG. 4 is a side elevational view of an alternative embodiment for a steam hair styling apparatus wherein a portion of the housing has been removed to reveal its internal structure.
Figure 5:
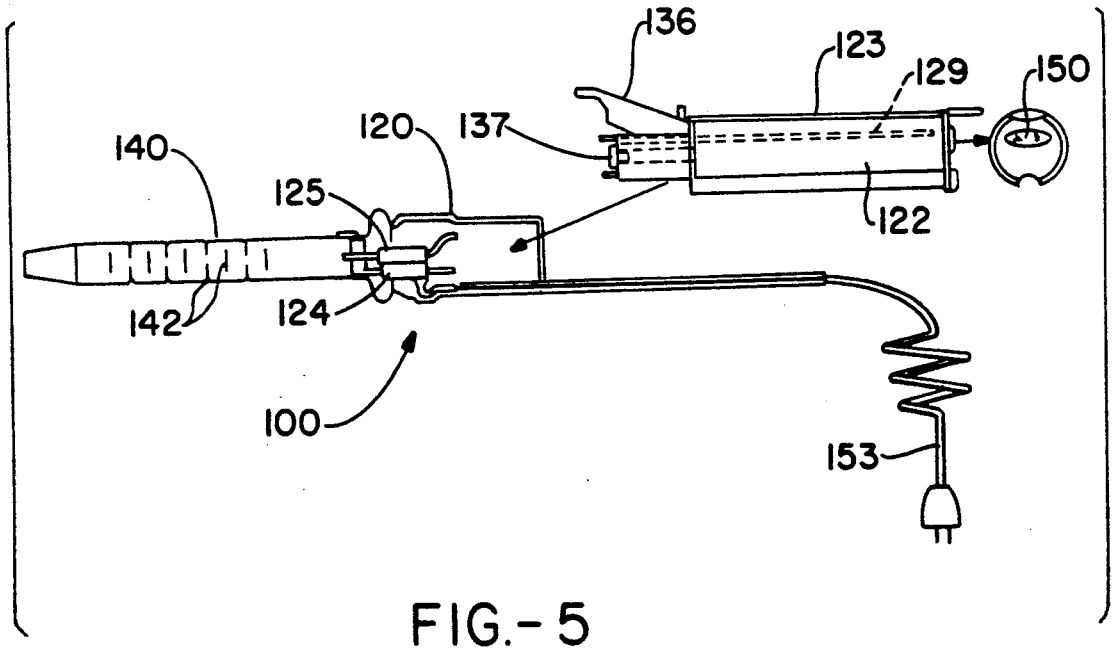
FIG. 5 is a side elevational view of an alternative embodiment for a steam hair styling apparatus, illustrating the detachable handle and wherein a portion of the housing has been removed to reveal its internal structure.
Figure 6:
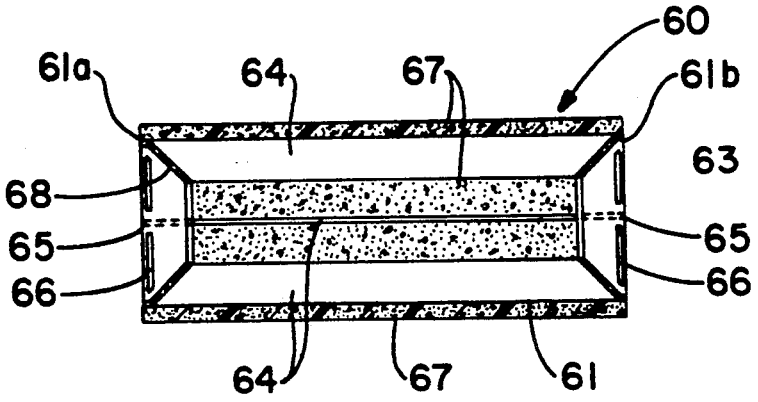
FIG. 6 is a side elevational view of a hair roller used in carrying out the process of the present invention and in conjunction with the steam hair styling apparatus disclosed herein.

FIGS. 4–6 illustrate an alternative embodiment, generally 100, of the present invention in which housing 120, handle 123 and barrel 140 are essentially co-axial, so as to resemble a conventional curling iron. As in the embodiment illustrated in FIGS. 1–3 housing 120 may contain a handle 123 which is detachable as shown in FIG. 5 or integrally attached thereto. Handle 123 contains a fluid reservoir 123 therein. As in the previous embodiments, a metered amount of fluid is drawn through tubes 129 and 127 by activation of a pumping mechanism by trigger 136. Although fluid tube 129 is illustrated as being essentially linear it should be appreciated that the tube can be flexible, or semi-rigid and configured as is known in the art to effectively and efficiently withdraw fluid from reservoir 122. The fluid is passed across heat plate 125 which is heated by heating element 124. This This heated fluid is therein atomized, exiting the steam emitting orifice 128 and into barrel 140. This steam exits barrel 140 through a plurality of steam emitting holes 142 disposed about the periphery of the barrel 140. Heating element 124 is supplied electrical current via 153. Apparatus 100 further includes a fluid viewing window 150 and the end of handle 123 opposite the barrel. As in the embodiment illustrated in FIGS. 1–3, a return trough 134 and return tube 135 are provided to return condensed fluid back to said reservoir 122.

As previously explained, apparatus 10 is typically intended for use in conjunction with hair wound upon a curler which has been substantially dried. The roller or curler 60, preferred embodiments of which are illustrated in FIGS. 6–9, is of the type which is cylindrical in shape having a outer shell open at both ends and defining an internal axial bore therethrough and of a structure so as to permit the easy migration of steam through the wall of the curler 60 and onto the hair. The barrel 40 of apparatus 10 is inserted into the bore of curler 60 whereupon the trigger is depressed actuating the withdraw of a specified amount of fluid from the reservoir and into the atomizer. This fluid is dispensed as a fine mist across a heating plate which rapidly vaporizes the fluid into a steam. The force of the atomizer urges the steam through the vapor cone and into barrel 40. The steam escapes the internal cavity of the barrel, through the curler and onto the adjacent hair. Due to the equal distribution of steam emitting apertures 42 about the periphery of barrel 40, the hair wound about the curler 60 all receives essentially uniform exposure to the steam, resulting in a lasting, resilient style.

Figure 7:
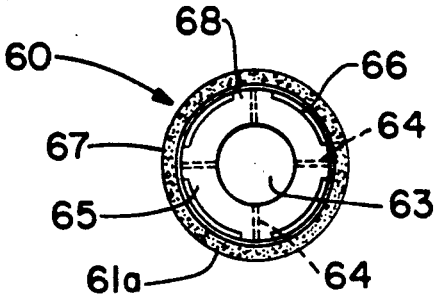
FIG. 7 is an end elevational view of the hair roller of FIG. 6.
Figure 8:
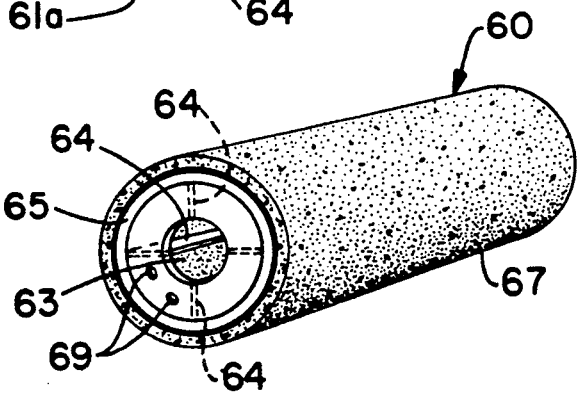
FIG. 8 is a perspective view of the hair roller of FIG. 6.
Figure 9:
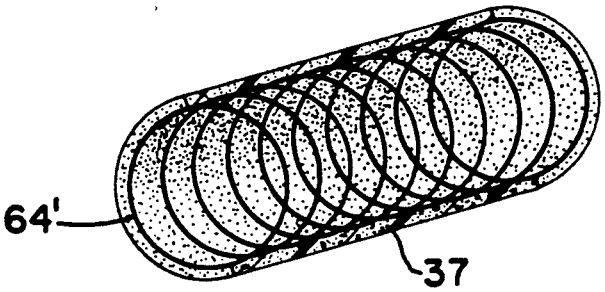
FIG. 9 is a perspective view of an alternative embodiment of the hair roller of FIG. 6 wherein the outer layer has been removed for purposes of illustration.

As is illustrated in FIGS. 6–9, applicant illustrates a curler 60 intended for use in conjunction with apparatus 10. Curler 60 has an essentially cylindrical body 61 with two open ends **61*a* and 61*b*, an axial internal bore 63 therethrough and is made of a plastic or wire frame structure 64. The embodiment of curler 60 as shown in FIGS. 6–8 has a flange 65 along the outer edge of each open end 61*a* and 61*b*. This flange 65 contains a plurality of slots 66 therein suitable in shape and dimension to receive hair clips or pins. Slots 66 are preferably in registry with corresponding slots on the opposing flange. An alternative curler embodiment 60' includes a frame structure 64 illustrated in FIG. 9** as a radially coiled spring.

The outer periphery of curler 60 may be disposed with an outer layer 67 of a highly porous foam or hook and loop as is known in the art.

Each open end 61*a* and 61*b* of curler 60 is fitted with a tapered cone structure 68 for directing barrel 40 of apparatus 10 or the like into the center of internal bore 63. Alternatively, tapered cone structure 68 may be integral with frame structure 64. If desired the tapered cone may contain a plurality of apertures 69 to permit the passage of steam therethrough. Additionally, the two opposing tapered cones may be interconnected by a counterbore (not shown) to further ensure the centralized orientation of barrel 40 within curler 60.

While in accordance with the patent statutes the best mode and preferred embodiment of the present invention has been described, it is to be understood that the invention is not limited thereto, but rather is to be measured by the scope and spirit of the appended claims.

What is claimed is:

1. An apparatus for styling hair through the application of steam, in combination with at least one tubular hair curler about which hair is wound comprising:

a tubular mandrel having a fixed diameter, a first and a second end and a plurality of apertures distributed substantially uniformly about its periphery along a substantial portion of its length, through which a vaporized fluid can pass;

a housing extending from the first end of the mandrel and having an internal cavity;

a refillable reservoir for containing fluid;

a vapor generating means within said housing cavity, said vapor generating means heating said fluid to vaporization; and a means for withdrawing a metered volume of fluid from said reservoir into contact with said vapor generating means and delivering said vaporized fluid into said mandrel; and at least one tubular hair curler, said curler being independent of said mandrel and housing, said curler receiving hair wound about its outer surface and having a diameter at least slightly greater than said tubular mandrel to receive a substantial portion of said mandrel therein.

2. The apparatus for styling hair according to claim 1 wherein said mandrel is constructed from an inefficient heat conductive material.

3. The apparatus for styling hair according to claim 2 wherein said mandrel is constructed from material comprising a thermoplastic.

4. The apparatus for styling hair according to claim 1 wherein said mandrel is constructed from material capable of rapid dissipation of heat.

5. The apparatus for styling hair according to claim 1 wherein said mandrel is constructed from material comprising aluminum.

6. The apparatus for styling hair according to claim 1 wherein said mandrel is replaceable with similar mandrels of varying diameter.

7. The apparatus for styling hair according to claim 1 wherein said apparatus further comprises a means for directing said vaporized fluid into said mandrel.

8. The apparatus for styling hair according to claim 1 wherein said refillable reservoir is detachably connected to said housing.

9. The apparatus for styling hair according to claim 1 wherein said apparatus further comprises means for returning undelivered fluid to said reservoir.

10. The apparatus for styling hair according to claim 1 wherein said vaporized fluid exiting said mandrel is at a temperature from about 100° C. to 150° C.

11. The apparatus for styling hair as recited in claim 1 wherein said curler further comprises:

an orienting means for maintaining said mandrel in a longitudinally centralized orientation within said curler.

12. The apparatus for styling hair as recited in claim 11 wherein said orienting means is a tapered opening in at least one end of said curler.

13. A method for styling hair comprising the steps of:

at least partially drying hair wound about a tubular hair curler having an axial bore therethrough, said tubular hair curler allowing vaporized fluid to pass radially therethrough;

providing a styling apparatus comprising a tubular mandrel having a fixed diameter and having a first and a second end and a plurality of apertures distributed substantially uniformly about its periphery through which vaporized fluid can pass, a housing extending from said first end of said tubular mandrel and having an internal cavity, a refillable reservoir capable of retaining fluid, a vapor generating means within said housing cavity, said vapor generating means heating fluid to vaporization, a means for withdrawing a metered amount of fluid from said reservoir into contact with said vapor generating means and delivering said vaporized fluid into said mandrel; inserting a substantial portion of said tubular mandrel into the bore of said tubular hair curler;

subjecting said hair wound about said tubular hair curler to the action of vaporized fluid at a temperature ranging from between 100° C. and 150° C.;

allowing the hair wound about said tubular hair curler to return to ambient temperature; and unwinding the hair from said tubular hair curler.

* * * * *